US009401568B1

(12) United States Patent
Masuda et al.

(10) Patent No.: US 9,401,568 B1
(45) Date of Patent: Jul. 26, 2016

(54) CONNECTING DEVICE AND ELECTRONIC DEVICE

(71) Applicant: Sony Mobile Communications Inc., Tokyo (JP)

(72) Inventors: Kiyohioto Masuda, Tokyo (JP); Seigo Fukunaga, Tokyo (JP); Taro Ishii, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 0 days.

(21) Appl. No.: 14/732,560

(22) Filed: Jun. 5, 2015

(51) Int. Cl.
*H01R 13/6581* (2011.01)
*H01R 13/6594* (2011.01)
*H01R 13/52* (2006.01)

(52) U.S. Cl.
CPC ..... *H01R 13/6581* (2013.01); *H01R 13/5202* (2013.01)

(58) Field of Classification Search
CPC ..... H01R 13/6581; H01R 13/6594; H01R 13/65802; H01R 13/658; H01R 23/6873; H01R 23/7073
See application file for complete search history.

(56) References Cited

U.S. PATENT DOCUMENTS 6,379,184 B1 * 4/2002 Bassler ..... H01R 13/6625 439/607.27
7,108,552 B2 * 9/2006 Niitsu ..... H01R 23/6873 439/607.35
7,837,506 B1 * 11/2010 Chiang ..... H01R 13/506 439/607.27
7,922,535 B1 * 4/2011 Jiang ..... H01R 13/5205 439/271
7,997,937 B2 * 8/2011 Kondo ..... H01R 24/62 439/607.4
8,262,414 B1 * 9/2012 Li ..... H01R 13/6273 439/607.35
8,568,172 B1 * 10/2013 Lan ..... H01R 12/57 439/607.4
8,662,928 B1 * 3/2014 Xie ..... H01R 13/6594 439/607.35
8,740,649 B2 * 6/2014 Lan ..... H01R 13/506 439/607.4
8,956,187 B2 * 2/2015 He ..... H01R 13/504 439/607.35
8,974,249 B2 * 3/2015 Zhang ..... H01R 12/724 439/607.4
2011/0318963 A1 * 12/2011 Kamoya ..... H01R 12/79 439/607.35
2012/0231661 A1 * 9/2012 Song ..... H01R 23/6873 439/607.4

FOREIGN PATENT DOCUMENTS

WO WO 2011/108679 A1 9/2011

* cited by examiner

*Primary Examiner* — Gary Paumen
(74) *Attorney, Agent, or Firm* — Oblon, McClelland, Maier & Neustadt, L.L.P

(57) ABSTRACT

A connection device apparatus including a housing having tubular rectangle shape and a support portion integrally formed with the housing, a shell having a body portion with tubular rectangle shape, wherein the shell is supported by the support portion of the housing, and the body portion of the shell is provided with a first plurality of comb-teeth which project from an end side of an upper face of the body portion, a shield member configured to surround an end portion of the first plurality of comb-teeth of the body portion of the shell, and wherein the shield member is connected with the end portion of the first plurality of comb-teeth and the ground of the printed-circuit board, and a plurality of terminals arranged within the shell and supported by the support portion of the housing.

17 Claims, 13 Drawing Sheets

FIG. 12

| A1 | A2 | A3 | A4 | A5 | A6 | A7 | A8 | A9 | A10 | A11 | A12 |
|---|---|---|---|---|---|---|---|---|---|---|---|
| GND | TX1+ | TX1− | $V_{BUS}$ | CC1 | D+ | D− | SBU1 | $V_{BUS}$ | RX2− | RX2+ | GND |
| | | | | | | | | | | | |
| GND | RX1+ | RX1− | $V_{BUS}$ | SBU2 | D− | D+ | CC2 | $V_{BUS}$ | TX2− | TX2+ | GND |
| B12 | B11 | B10 | B9 | B8 | B7 | B6 | B5 | B4 | B3 | B2 | B1 |

CONNECTING DEVICE AND ELECTRONIC DEVICE

BACKGROUND

1. Field of the Disclosure

This disclosure is related with the connecting device which includes of a water-proof connector assembly provided with the noise immunity, and the electronic device provided with the connecting device.

2. Description of the Related Art

An electrical connector is an electromechanical device, which typically includes of a male part and a female counter part that can be connected to establish a secured electrical connection between at least two electronic components. The electronic device can be a mobile phone, television, personal computer, etc. A most widely used electrical connector includes a Universal Serial Bus (USB) interfaces which can be of several types such as USB 2.0, USB 3.0, micro-USB of type C etc. The connector includes terminals that can perform different functions such as data transmission, video transmission, audio transmission etc. The transmission from one device to another occurs via the connector in the form of electrical signals. Hence it is essential to have a waterproof connection to prevent damage to the electronic devices.

A conventional waterproof connector such as a micro-USB female side connector is includes a housing and a metal shell composed of the connector configuration are insert-molded using resin material. Additionally a sealing material part is included along the circumference of the housing that can tightly fit against a counterpart on the male side connector. The terminals that are not covered properly may lead to deterioration of electrical performances such as communication.

An example connector having a waterproof property is disclosed in International Publication WO2011/108679 (Japan application; Japanese Patent Application No. 2012-503269). It has a seal attached along the outer circumference of the housing and a shell mounted inside the housing. As the seal is disposed outside the shell and the housing, size of the connection device increases creating space problem especially in a micro-USB type connections. Moreover, the position of the gasket (sealing member) for waterproof purpose is located in the edge part vicinity at the side of plug insertion of a micro-USB female side connector. Since the height of the shell inside a micro-USB female side connector is decided by the technical standard, thickness of the micro-USB female side connector may not be reduced because a gasket exists in the edge part vicinity at the side of plug insertion.

Furthermore, the connector includes terminals that exchange data and are susceptible to creating noise due unwanted to electromagnetic interference that may leading to chattering noise during operation.

There remains a continuing need to provide improved electric connector with better water proofing ability and electric performance. Further, downsizing the connector is an important consideration in connector design.

SUMMARY

According to an embodiment of the present disclosure, there is provided a connection device apparatus. A connection device according to the present disclosure is a watertight connector assembly with improved noise immunity. As an example, the connection device can be applied to the female side connector of a USB connection or the like. The connection device includes a housing, a metallic shell arranged within the housing having a plug insertion side and an inner side, a metallic shield member, and a plurality of terminals arranged within the metallic shell and supported by the housing.

The housing has a bottomed rectangular tubular shape. The housing has a support portion for supporting the metallic shell and the plurality of terminals. The support portion is integrally formed with the housing. The housing further includes a sealing member, wherein the sealing member is brought into pressure contact with a face of a casing of an electronic device. The housing is configured to be attached the sealing member in a position deeper than the body portion of the shell of the housing.

The metallic shell has a body portion with a rectangular tubular shape into which a plug is to be inserted. The body portion of the metallic shell is provided with a first plurality of comb-teeth which project from an end side (which is opposite to the plug insertion side) of an upper face (which is a face of the metallic shell on the farther side from a printed-circuit board) of the body portion. The first plurality of comb-teeth are arranged at positions corresponding to respective terminals for transmitting data (i.e., data transmission terminals), among the plurality of terminals. The first plurality of comb-teeth are formed in a plug insertion direction at positions corresponding to the plurality of terminals respectively. Each of the first plurality of comb-teeth at least has a portion parallel to the direction in which the plurality of terminals extend. A connecting portion extending in the plug insertion direction is provided on an end of a side face of the body portion of the metallic shell, wherein the connecting portion connects the side face of the body portion of the metallic shell and the metallic shield member.

A second plurality of comb-teeth project from an end side of a lower face of the body portion of the metallic shell. The second plurality of comb-teeth projecting from the lower face of the body portion has a portion with the significantly similar height as that of the first plurality of the comb-teeth projecting from the upper face, and the end of the second plurality of comb-teeth is connected with the printed-circuit board. The second plurality of comb-teeth projecting from the lower face of the body portion of the metallic shell extends straight in the plug insertion direction thereof connecting with the body portion.

A third plurality of comb-teeth project from the upper face and the lower face of the body portion of the metallic shell, wherein the second plurality of comb-teeth correspond to the positions of the terminals for transmitting data (Type-C) respective, among the plurality of terminals.

The metallic shield member is configured to surround an end portion (on the inner side) of the plurality of comb-teeth of the body portion of the shell. The metallic shield member is connected with the end portion of the first plurality of comb-teeth and the ground of the printed-circuit board. The metallic shield member has a first surface and a second surface, wherein the first surface is parallel to the first plurality of comb-teeth, and the second surface is perpendicular to the first surface. A cutout is formed in the second surface of the metallic shield member, at a position corresponding to the end portion of the first plurality of comb-teeth.

Further, an electronic device apparatus includes a connection device that includes a housing, a metallic shell arranged within the housing, a metallic shield member, and a plurality of terminals arranged within the metallic shell and supported by the housing. The electronic device further includes a casing for housing a printed-circuit board connected with the plurality of terminals and the metallic shield member of the connection device The forgoing general description of the illustrative implementations and the following detailed description thereof are merely exemplary aspects of the teachings of this disclosure, and are not restrictive.

BRIEF DESCRIPTION OF THE DRAWINGS

FIG. 12 is an arrangement of the terminals of USB Type-C according to an exemplary embodiment of the present disclosure.

DETAILED DESCRIPTION

Figure 1:
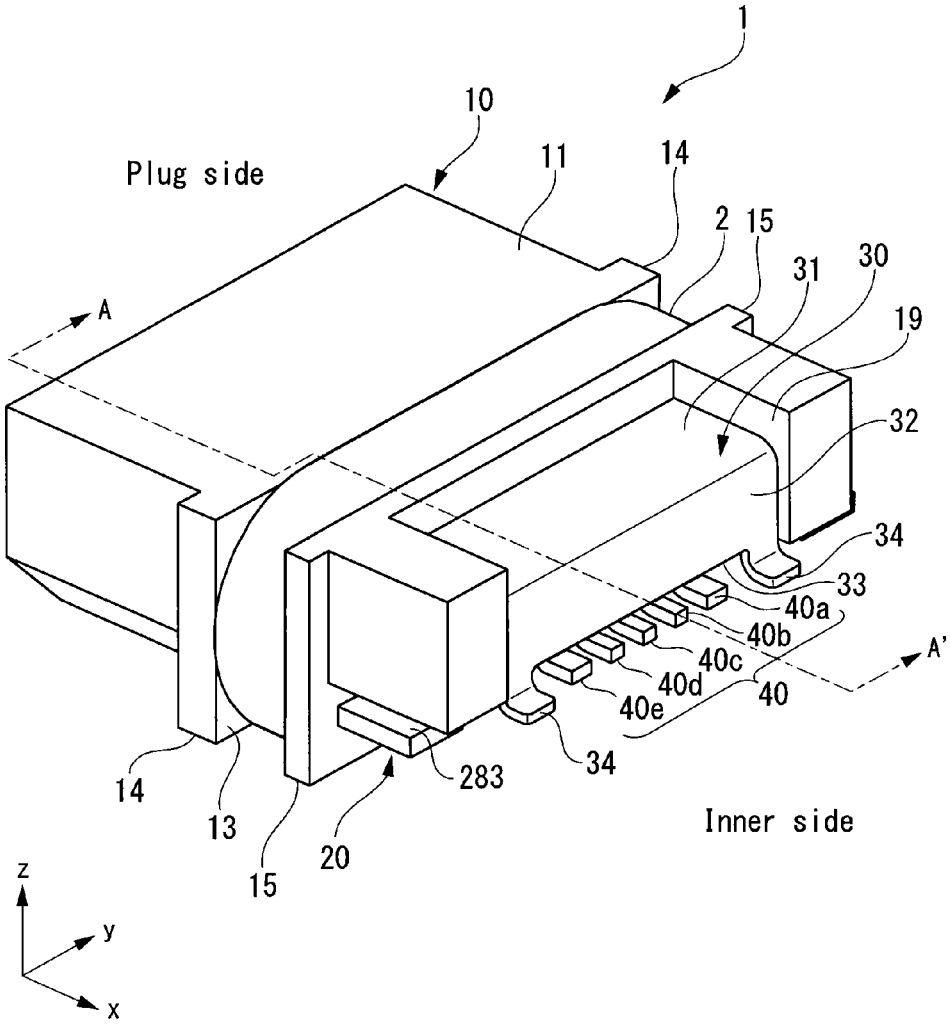
FIG. 1 is the perspective view of the connecting device for a micro-USB Type-B female side connector according to an exemplary embodiment of the present disclosure.

In the drawings, like reference numerals designate identical or corresponding parts throughout the several views. Further, as used herein, the words "a", "an" and the like generally carry a meaning of "one or more", unless stated otherwise. The drawings are generally drawn to scale unless specified otherwise or illustrating schematic structures or flowcharts.

Furthermore, the terms "approximately," "proximate," "minor," and similar terms generally refer to ranges that include the identified value within a margin of 20%, 10% or preferably 5% in certain embodiments, and any values therebetween.

FIGS. 1-5 illustrate the construction of a connecting device 1 according to an embodiment of the present disclosure. The insertion direction of the connecting device 1 is in the x-direction also referred to as first direction. Orthogonal to x-direction is the y-direction also referred to as second direction. And the direction orthogonal to x-direction and y-direction is z-direction also referred as third direction. The connecting device 1 is a connector assembly used transfer electric current to an electrical or an electronic device such as mobile telephone, television, laptops, computers etc. via connector installed on these devices. The connecting device 1 shown in FIGS. 1-5 is an example for connecting to a micro-USB Type-B female side connector installed on an electrical or an electronic device.

FIG. 1 is a perspective view of the connecting device for connecting to a micro-USB Type-B female side connector according to an exemplary embodiment of the present disclosure. The connecting device 1 in FIG. 1 includes a housing 10, a metal shell 20, a shield member 30, and a terminal group 40. The housing 10 has a significantly rectangular upper-surface 11 and a significantly rectangular tubular shape. The housing 10 are made of resin, the shell 20 and the shield member 30 are made of metal such as copper, steel, aluminum, etc. The shell 20 is an integral part of the housing 10, while the terminal group 40 is supported by internal support member of the housing 10. The internal structure of the housing will be discussed later in the embodiment. The construction of shell 20 is discussed in further detail with reference to FIGS. 2-5.

Figure 6:
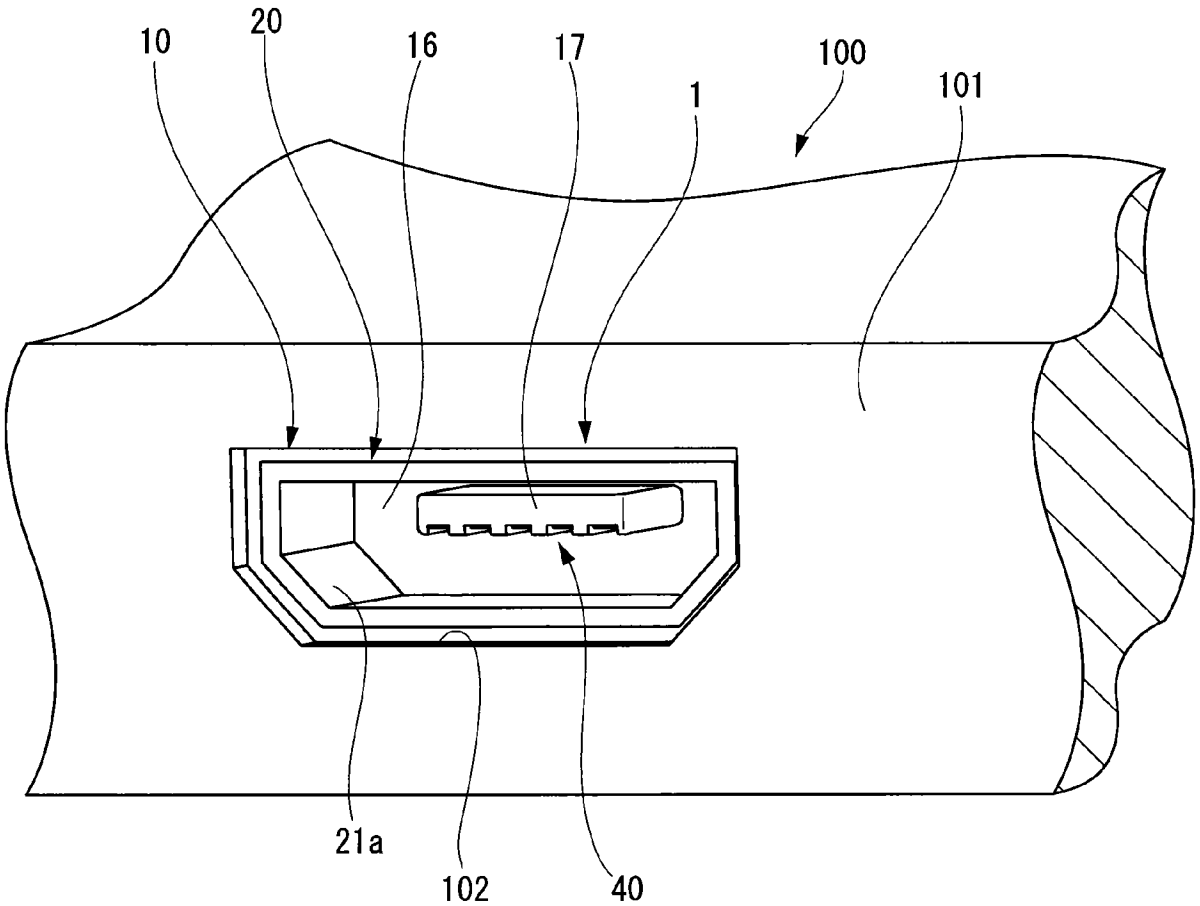
FIG. 6 is a perspective view an example electronic device carrying the connecting device according to an exemplary embodiment of the present disclosure.

Referring to FIG. 1, the housing 10 includes a groove 13. The groove 13 is formed between an engaging part 14 and an engaging part 15. The engaging parts 14 and 15 enable a connection between the connecting device 1 and an electronic device 100 (not shown in FIG. 1). Referring to FIG. 6, the engaging parts 14 and 15 (not visible) are engaged with the member (not shown) in the housing body 101 of the electronic device 100 and are latched together.

Referring back to FIG. 1, a sealing member 2 is fixed in the groove 13. The sealing member 2 is formed, for example by soft resin softer than resin of the housings 10, such as an elastomer. The sealing member 2 mounted along the circumference of the housing 10 is press-fitted with the surface of the housing side of the electronic device 100 (not shown). The sealing member 2 creates a waterproof seal when press fitted with the electronic device 100 (not shown) and prevents water from entering the electronic device through the gap of a housing side of the electronic device 100 (not shown.

A shield member 30 is placed over the terminal group 40, which projects out under a cutout 33 of the shield member 30. The shield member 30 has a first surface 31 parallel to the upper surface 11, a second surface 32 orthogonal to the first surface 31 and two ground portions 34, 34 projecting from the second surface 32. The shield member 30 is connected with the ground of the printed circuit board 50 (shown in FIG. 2) via the ground portions 34, 34. Connections of the shield member 30 with the internal part of the housing are discussed with respect to FIG. 2. The shield member 30 also serves as a noise countermeasure for the terminals 40*a*-40*e*.

The connections between different elements of the connecting device 1 inside the housing 10 are discussed with reference to the FIG. 2.

Figure 2:
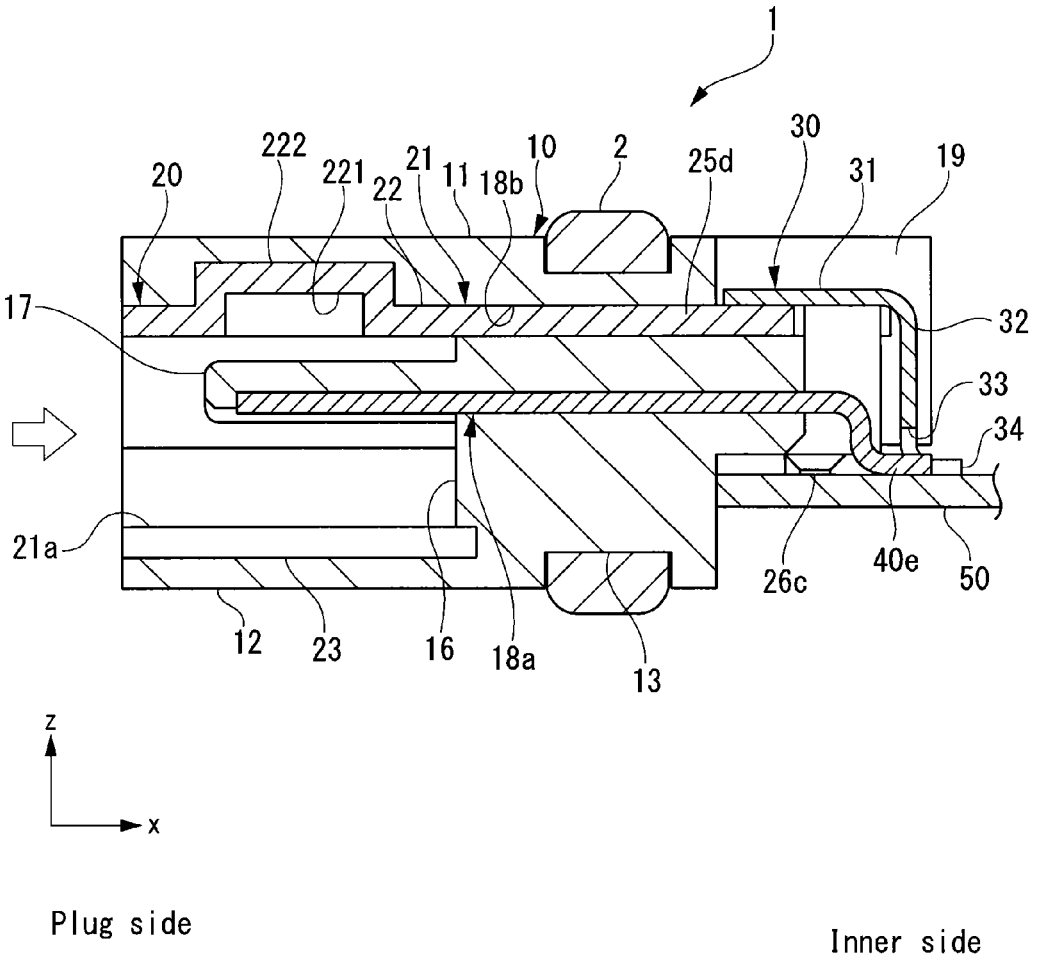
FIG. 2 is a sectional view of the connecting device about a section line A-A' of FIG. 1 according to an exemplary embodiment of the present disclosure.

FIG. 2 is a sectional view of the connecting device about A-A' arrow directional view of FIG. 1 according to an exemplary embodiment of the present disclosure. The housing 10 is equipped with the shell 20, which is formed integrally with the housing 10 between the upper surface 11 and a lower surface 12, and a support part 16 which supports a plurality of the terminals 40*a*-40*e*. The support part 16 has a plurality of first through-holes collectively referred as 18*a* and a plurality of second through-holes collectively referred as 18*b*. The plurality of through-holes 18*a* and 18*b* are parallel to the insertion direction i.e. x-direction (arrow of FIG. 2) of the plug (e.g., micro-USB Type-B male connector) inserted in the shell 20.

In one embodiment, the number of the plurality of first through-holes 18*a* is five. The plurality of the first through-holes 18*a* tightly encloses the terminals 40*a*-40*e* (terminal group 40). Further, the number of the plurality of the second through-holes 18*b* is six. The plurality of the second through-holes 18*b* tightly encloses comb-teeth 25*a*-25*d*, 26, and 26.

The housings 10, the terminals 40*a*-40*e*, and the shell 20 are manufactured and assembled using insert molding. The plurality of the first through-holes 18*a* and the plurality of the second through-holes 18*b* are created during an insert molding process. The insert molding process establishes a tight sealing between the housing 10, the terminals 40*a*-40*e*, and the shell 20. The tight sealing blocks the water from penetrating to a printed circuit board (PCB) 50 from the plug insertion side. The printed circuit board 50 may be mounted on a flexible substrate.

The shell 20 has the rectangular-tube-shaped main-body part (shell main body) 21. A plug can be inserted from the opening 21*a* of the shell 20. A support protrusion 17 of the housing 10 protrudes toward the opening 21*a* from the inner side of the shell main body 21. The connecting terminal (not shown) provided in the plug (not shown) contacts with terminal 40*a*-40*d* inserted by the support protrusion 17.

The support protrusion 17 protrudes from the support part 16 toward a hollow part at the side of plug insertion. The support protrusion 17 includes grooves corresponding to the number of terminals of the terminal group 40. The grooves on the support protrusion 17 are formed during the inserting molding process. The edges of terminal 40*a*-40*d* are completely inserted and supported in each groove of the support protrusion 17, respectively. FIG. 6 more clearly illustrates the support protrusion 17 and the terminal group 40 when the connecting device 1 is installed on the electronic device 100.

The inner surface of the shell main body 21 includes a pair of fixing holes 221 and a pair of projecting portions 222. The fixing holes 221 are used for fixing a hook of the plug (not shown). Corresponding to the pair of the fixing holes 221, the pair of the projecting portions 222 is formed on the outer surface of the shell main body 21. Further, corresponding to the pair of the projecting portions 222, a pair of recessed parts (not marked) is formed on the inner surface of the housing 10.

Furthermore, the shell main body 21 has a plurality of comb-teeth 25*a*-25*d*. The plurality of comb-teeth 25*a*-25*d* protrude towards the opposite side of the plug insertion side and are formed at an edge in the upper-surface part 22 which is a side far from the printed circuit board 50. Each comb-teeth 25*a*-25*d* is formed in the position corresponding to the terminals 40*a*-40*e* (more clearly illustrated in FIG. 4)

The housing 10 also includes the groove 13 along the circumference of the housing 10. The groove 13 is formed closer to the side opposite of the plug insertion (which will be referred as "inner side" hereafter) in the housing 10 and away from the projecting portions 222 of the shell main body 21 part (which may be referred as a "shell main body") of the shell 20. Furthermore, the groove 13 position corresponds to comb-teeth 25*a*-25*d*, 26 (shown in FIG. 3-5). The annular sealing member 2 is tightly mounted in the groove 13 and can be further fitted to a surface (not shown) of the electronic device 100 (in FIG. 6) establishing a tight sealing between the connected members. Therefore, the sealing member 2 is also provided on an inner side compared with the shell main body 21 in the housing 10. The position relationship between the pair of the projecting portions 222 and the sealing member 2 (i.e., by arranging the flexible sealing member 2 towards the inner side of the pair of the projecting portions 222) bring an advantage of thickness reduction of the connecting device 1.

The degree freedom for design changes is higher on an inner side than in the shell main body 21 (shown in FIGS. 2-5) in which the plug is inserted in the housing 10.

The shield member 30 is fitted in the mounting part 19 which is notched on the inner side of the upper-surface part 11 of the housing 10. The shield member 30 is a Z-shaped significantly right angled member having the first surface 31, the second surface 32, the cutout 33 and the ground portion 34. The first surface 31 is significantly parallel to the comb teeth 25*a*-25*d* and fixed internally, for instance by laser welding the inner side of the shielding member 30 to the comb teeth 25*a*-25*d* and the upper-surface part 282. The second surface 32 is orthogonal to the first surface 31 and maintains a gap between the comb-teeth 25*a*-25*d* and also between the terminal group 40. The shield member 30 is connected with the ground of the printed circuit board 50 via the ground portions 34.

Figure 3:
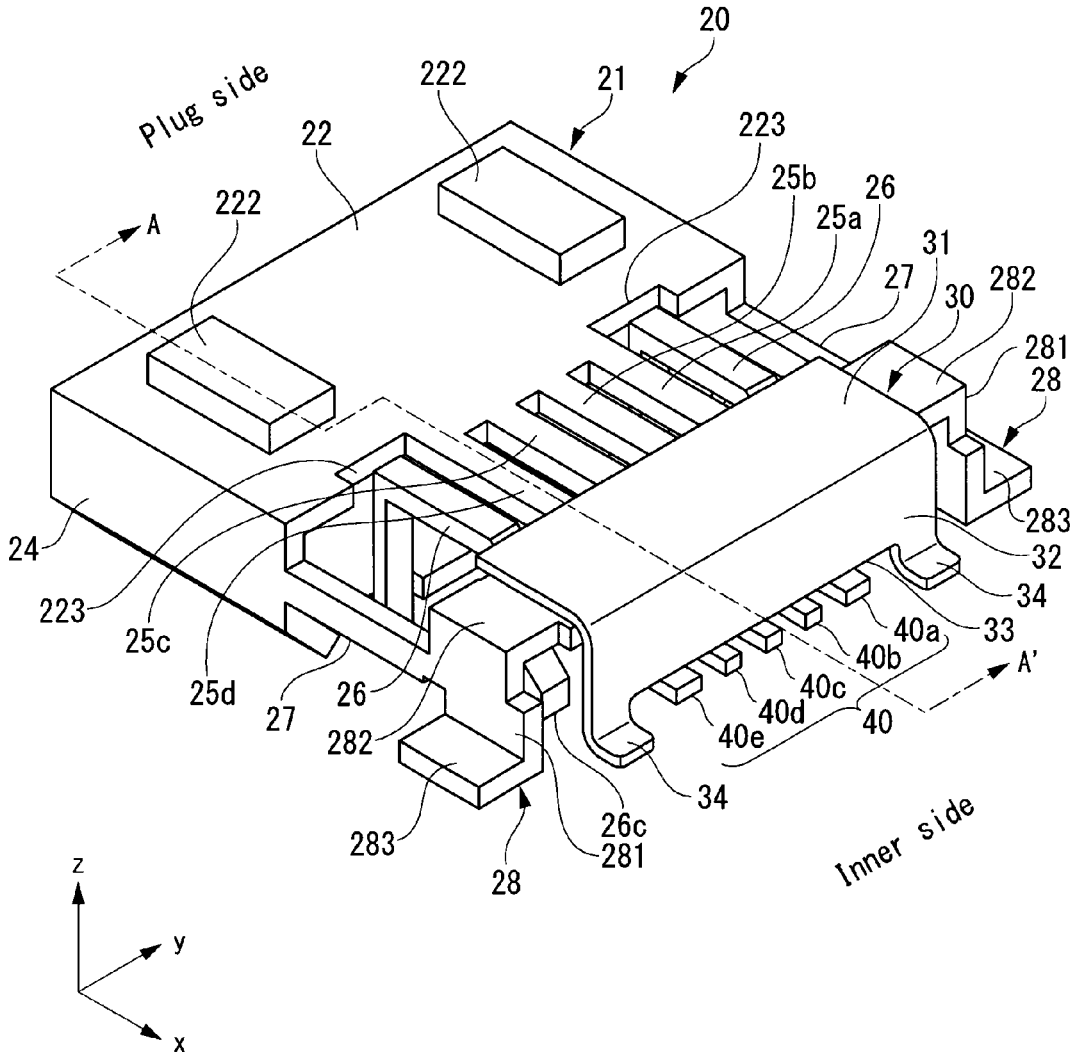
FIG. 3 is a perspective view of an upper surface side of a shell, of the connecting device in FIG. 1, supporting a shield member according to an exemplary embodiment of the present disclosure.

FIG. 3 is a perspective view of an upper surface side of shell main body 21 supporting the shield member 31. The upper surface 22 of the shell main body 21 includes the pair of projecting portions 222 located closer to the plug insertion side. The projecting portions 222 are separated away from one another along the y-direction and located closer to the side faces 24 of the shell main body 21. On the inner side (i.e. opposite of the plug insertion side) a support portion 28 for the shield member 30 is included. The shield member 30 is supported on an upper surface 282 of the support portion 28.

The shield member 30 encloses a significant portion of the plurality of the terminals 40*a*-40*e* and is grounded via ground portions 34 as well as the upper surface 282. A grounded enclosure reduces the unwanted electromagnetic coupling and the noise generated from the terminals 40*a*-40*e* or external sources significantly. The shield member 30 has the first surface 31 parallel to the plurality of the comb-teeth 25*a*-25*d*, 26 and the part of the plurality of the comb-teeth 25*a*-25*d* is soldered to the first surface 31. The second surface 32 orthogonal to first surface 31 has the cutout 33 corresponding to the terminals 40*a*-40*e*. The terminals 40*a*-40*e* are enclosed from two directions by the shield member 30. A pair of ground portions 34 and 34 on both the sides of the cutout 33 of the shield member 30 are bent in the direction (x direction) parallel to the printed circuit board 50 (not shown). Thereby, the contact area of the ground portions 34 and 34 and the printed circuit board 50 is increased. Thus ensuring that the ground portions 34 and 34 reliably connect, for instance by soldering, to the ground part of the printed circuit board 50.

Figure 4:
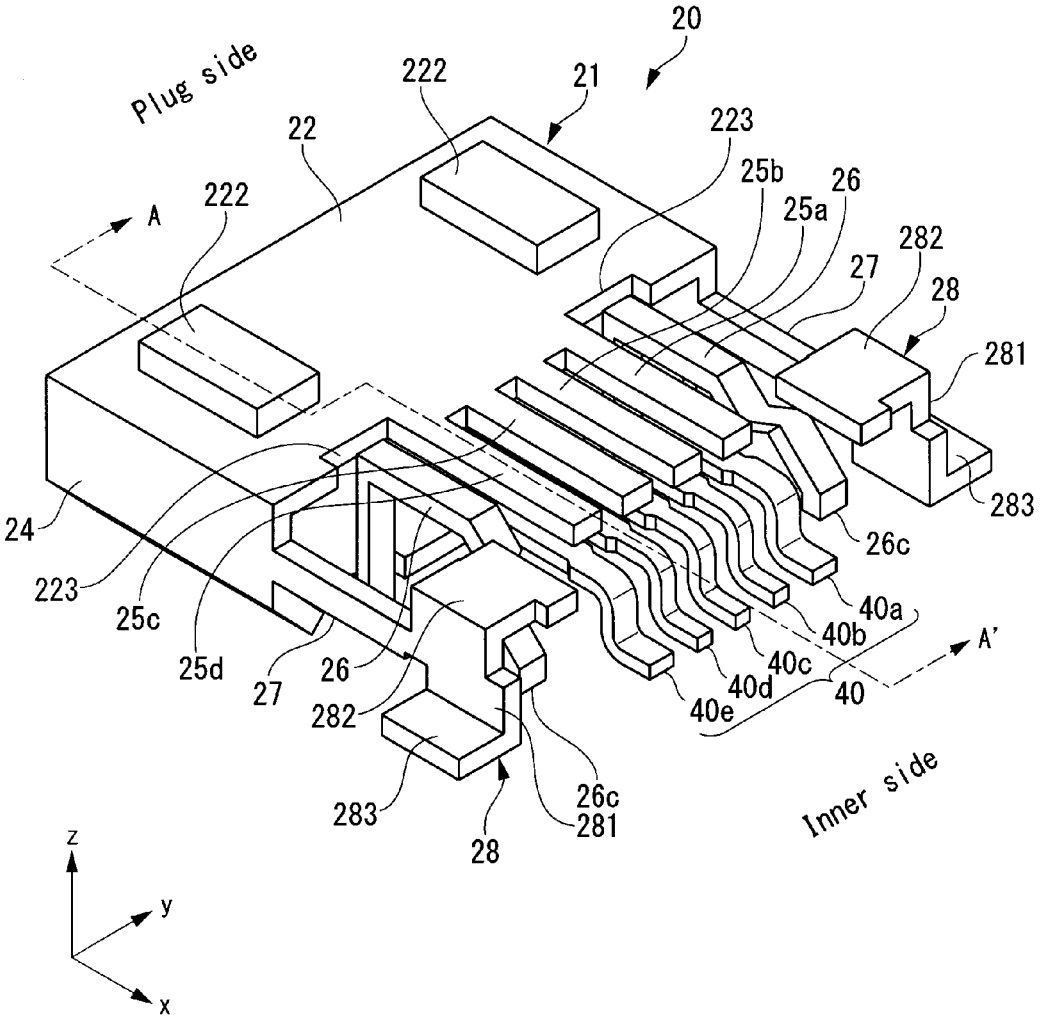
FIG. 4 is a disassembled perspective view of the shell of the connecting device in FIG. 1 according to an exemplary embodiment of the present disclosure.

FIG. 4 is a disassembled perspective view of the shell of the connecting device in FIG. 1 according to an exemplary embodiment of the present disclosure. The shell main body 21 has the plurality of comb-teeth 25*a*-25*d* in the upper-surface part 22 and the plurality of comb-teeth 25*a*-25*d* protrudes towards the inner side (i.e. the opposite side to the plug insertion side). The plurality of the comb-teeth 25*a*-25*d* is arranged at roughly equal intervals in a direction (y direction) perpendicular to the plug insertion direction. Each of the comb-teeth 25*a*-25*d* corresponds to one or more of the terminals 40*a*-40*e* in the plug insertion direction and each of the comb-teeth 25*a*-25*d* is placed above the terminals 40*a*-40*e*. Further, it is desirable to provide the comb-teeth 25*a*-25*d* in the positions corresponding to a terminal(s) (data transmission terminal) through which data is transmitted. For example, in the case of a Micro-USB Type-B male side connector, the terminals 40*b* and 40*c* are data transmission terminals (D+, D−). Therefore, it is desirable to at least provide comb-teeth in the position corresponding to the terminals 40*b* and 40*c* in a y direction. Such as selective positioning of the comb-teeth 25*a*-25*d* within the shell 21 structure enables reduction in noise generated from the terminals 40*a*-40*e* (especially terminals 40*b* and 40*c*) or external sources.

The positioning of the comb-teeth 25*a*-25*d* is not limited to the above discussion. The comb-teeth 25*a*-25*d* need not be arranged exactly above the terminals 40*b* and 40*c*. Other arrangement of the comb-teeth 25-25*d* that preserves an equivalent electrical property (such as noise immunity) or similar to the arrangement of the comb teeth above the terminals 40*b* and 40*c* are acceptable. Furthermore, referring to FIG. 5, additional pair of comb-teeth 26, closer to the two side surfaces 24 of the shell main body 21 separated along the y-direction, protrude from the edge of the lower surface 23 of the shell main body 21.

Figure 5:
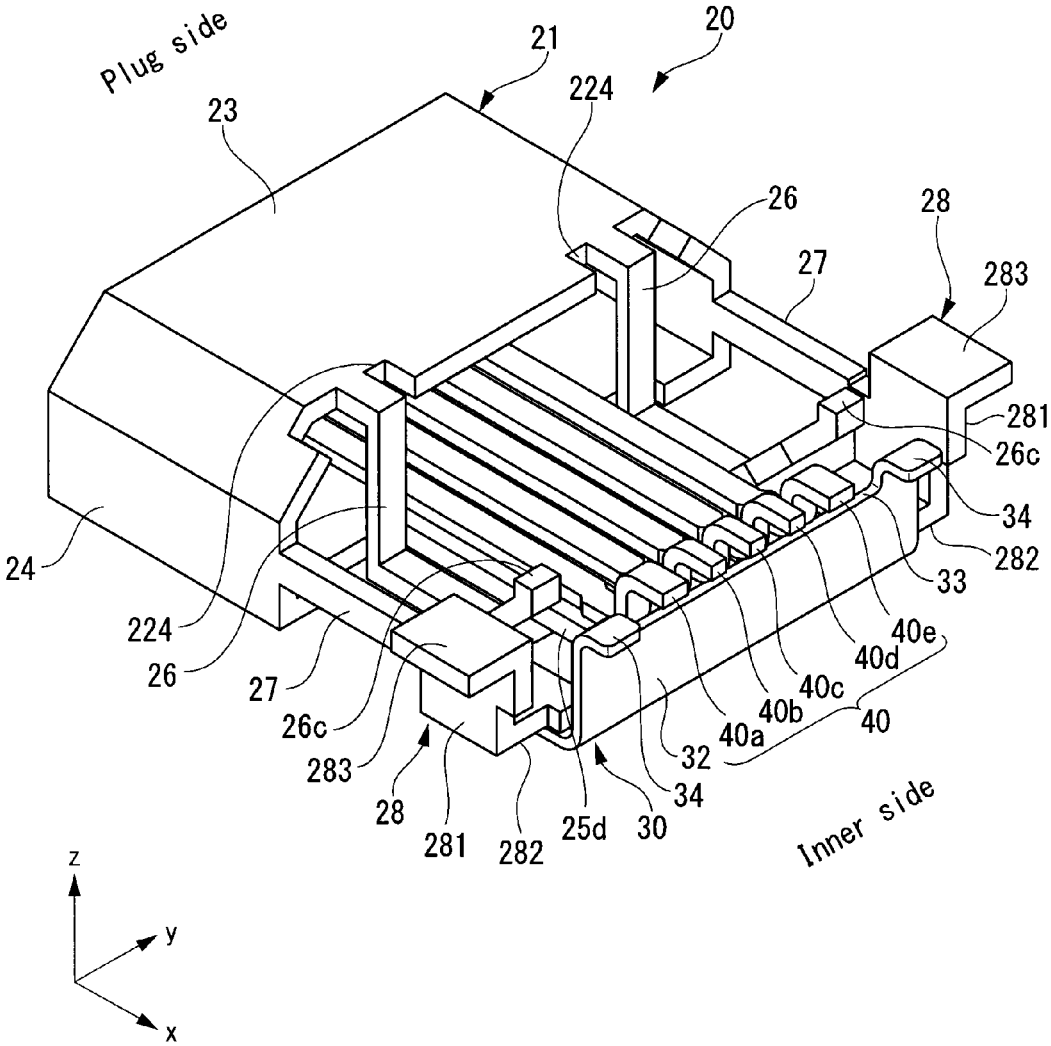
FIG. 5 is a perspective view of a lower surface side of the shell of the connecting device in FIG. 3 according to an exemplary embodiment of the present disclosure.

FIG. 5 is a perspective view of a lower surface 23 of the shell 20 of the connecting device 1 in FIG. 4 according to an exemplary embodiment of the present disclosure. The pair of comb-teeth 26 extends from the lower surface side 23 towards the upper surface 22 in an orthogonal manner till the comb-teeth 26 are at the same level as comb-teeth 25*a*-25*d* and further a part of the comb-teeth 26 extends to become parallel to the terminals 40*a*-40*e*. Thus comb-teeth 26 forms a Z-like shape. Each of the comb-teeth 26 also includes a grounding portion 26*c*. The grounding portion 26*c* is an edge of the comb-teeth 26 that connects with the ground of the printed circuit board 50 (not shown). The grounding portion 26*c* can be soldered to the ground part of the printed circuit board 50 (not shown), similar to soldering of the grounding portion 34 of the shield member 30 to the printed circuit board 50 (not shown).

Each of the comb-teeth 26 has a part that becomes parallel with the terminals 40*a*-40*e*, and serves to reduce the noise which may be generated from the terminals 40*a*-40*e*. The structure including the comb-teeth 26 and a pair of connection parts 27 creates a barrier around the terminals 40*a*-40*e* that can help noise reduction from external source. Further, raising pathways to the ground (i.e., via the comb-teeth 25*a*-25*d* and 26, and via a pair of connection parts 27) can enhance the function of ground that leads to leads to noise reduction.

Each comb-teeth 25*a*-25*d* and 26 can include at least one part parallel to the direction (x-direction) in which the terminals 40*a*-40*e* extends. As the area where the comb-teeth 25*a*-25*d*, and 26 enclose the terminals 40*a*-40*e* increases, the electrical property (such as noise reduction) of the connecting device 1 improves.

The connecting device 1 is not limited to having all comb-teeth 25*a*-25*d*, 26 extending over the terminals 40*a*-40*e*. Further, a comb-teeth having a shape such that at least one part is parallel to the direction (x direction) and extends over the terminals 40*a*-40*e* extend is acceptable.

Referring to FIGS. 4 and 5, a pair of connection parts 27, extending towards the inner side, are provided at the edge part of the side surfaces 24 and located between the lower-surface 23 and the upper-surface 22 of the shell main body 21. The pair of connection parts 27 are connected to a pair of shield member support parts 28 respectively via base portions 281 of the shield member support parts 28. The base portions 281 are parallel to x-z plane and connected to the connection parts 27 respectively. Further, the shield member support part 28 includes the upper-surface part 282 connected to the upper part of the base portion 281, and the grounding portion 283 connected to the lower part of the base portion 281. The upper-surface part 282 is bent inwards in x-y plane, i.e. towards the comb-teeth 25*a*-25*d*, and connected to the shielding member 30 (not shown). While the grounding portion 283 is bent outwards in the x-y plane, i.e. away from the comb-teeth 25*a*-25*d*, and connected to the ground part of the printed circuit board 50 (not shown).

According to one embodiment, the shell 20 has four comb teeth 25*a*-25*d* on the upper surface 22 and has two comb teeth 26 on the lower surface 23, and has two connection parts 27 extending from the side surface 24. Thus, a grounding function is reinforced via several connection parts (or connection route). As such, the noise generated from the terminals 40*a*-40*e* or external sources can be reduced.

Furthermore the shell main body 21 has a plurality of notch 223 on the upper-surface 22 (in FIG. 4), and a plurality of notches 224 on the lower-surface 23 (in FIG. 5). The plurality of notches 223 is provided to accommodate the comb-teeth 26 such that the comb-teeth 26 are at same level as the other comb-teeth 25*a*-25*d* on the upper surface 22. The plurality of notches 224 are provided to increase the dimensions of the comb-teeth 26. Thereby, as the notch size of the plurality of notches 224 increases the length of the part comb-teeth 26 parallel to the terminals 40*a*-40*e* on the lower surface 23 can increase. The connecting device 1 having the plurality of notches 223 and 224 contributes to the improvement of the electrical property of the terminals 40*a*-40*e*. Moreover, by providing a plurality of notches 223 and 224, the position of the edge of the shell main body 21 corresponding to these notches stay close to the plug insertion side, thus improving the waterproofness.

In another embodiment, it is possible to extend the shell main body 21 towards the inner side (side opposite of the plug insertion side), and it is possible to enclose the terminals 40*a*-40*e* only by the shell main body 21. However, in such a case, the area (contact area) of the joining part of the shell 20 and the housing 10 becomes large. That is, the joining part of the shell 20 and the housing 10 may reach near the printed circuit board 50 on the inner side. This increases the possibility that the water entering a crevice between the shell 20 and the housing 10 may enter into the printed circuit board 50. On the other hand, by shortening the length of the shell main body 21 along the plug insertion direction (x direction), according to the present disclosure, the possibility that the printed circuit board 50 come in contact with water is significantly low and maintains a high level of waterproofness. Thus, according to one embodiment of present disclosure the connecting device 1 (connector assembly) is waterproof and achieves noise reduction due the structure of the device.

FIG. 6 is a perspective view an example electronic device carrying the connecting device according to an exemplary embodiment of the present disclosure. The electronic device 100 includes the housing body 101 in which an opening 102 extending inside the electronic device 100. The connecting device 1 connected to the printed circuit board 50 (not visible) are accommodated inside the housing body 101.

The opening 102 in the housing body 101 of the electronic device 100 has a shape corresponding to the shape of the opening 21*a* of the shell 20, which is a part of the connecting device 1 according to one embodiment of present disclosure. Further, in FIG. 6, the housing 10 and the shell 20 of the connecting device 1 can be seen from the opening 102 of the housing body 101 of the electronic device 100.

A plug (not shown) having connecting terminals is inserted in the opening 21*a* of the shell 20 of the connecting device 1 mounted in the electronic device 100. The connecting terminals of a plug (not shown) and each terminal of the terminal group 40, provided in the support protrusion 17 of the connecting device 1, contact physically.

The housing 10 of the connecting device 1 can be fixed to the housing body 101, for example using a screw. However, the present disclosure is not limited to a particular fixing mechanism and the connecting device 1 can be mounted in the housing body 101 of the electronic device 100 using other fixing methods such as adhesives, soldering, etc. Further, the electronic device 100 may be equipped with an accommodating part which adheres and accommodates the connecting device 1.

Figure 7:
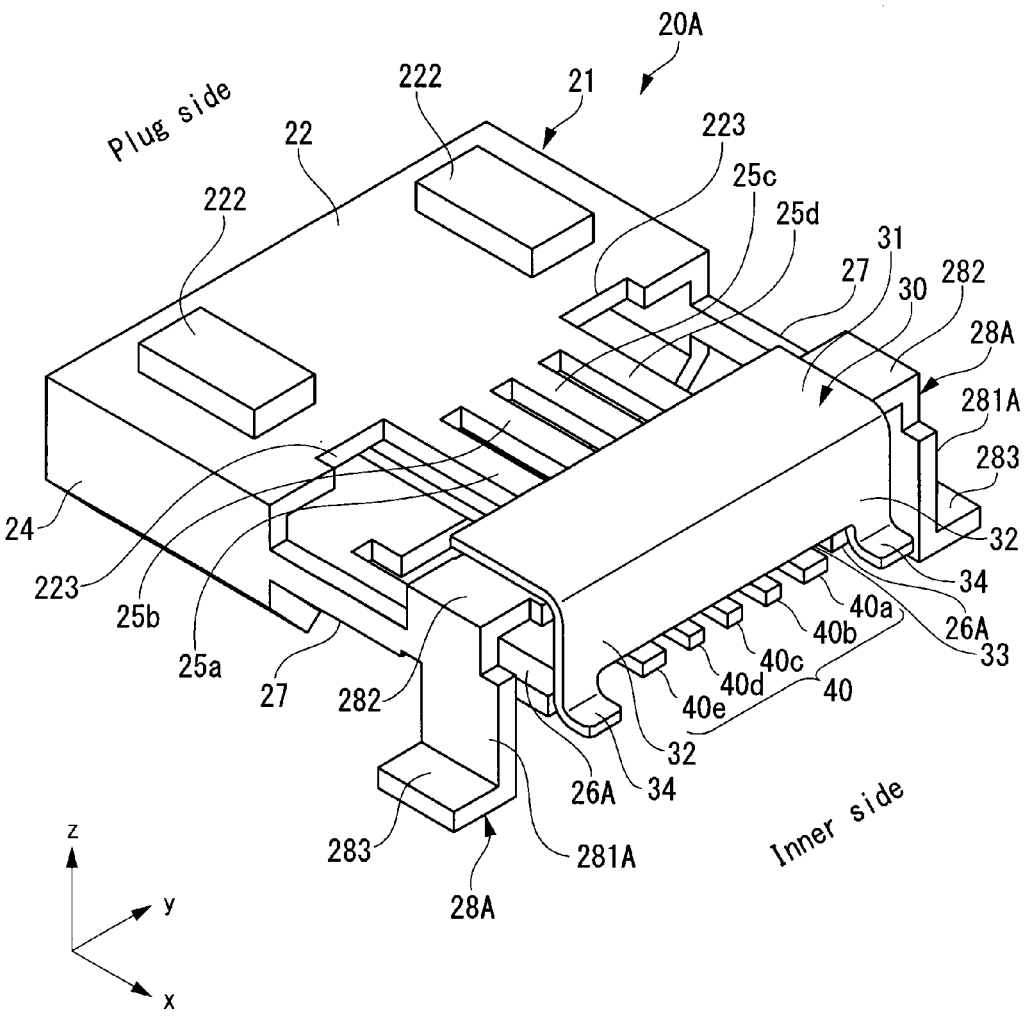
FIG. 7 is the perspective view of an upper surface side of a shell of a connecting device according to an exemplary embodiment of the present disclosure.

In another embodiment, the shell 20 can modified to develop shell 20A. FIG. 7 is the perspective view of an upper surface side of the shell 20A according to an exemplary embodiment of the present disclosure. Notice that the shell body 20A is different, particularly the comb-teeth structure of the shell body 20 according to one embodiment.

Figure 8:
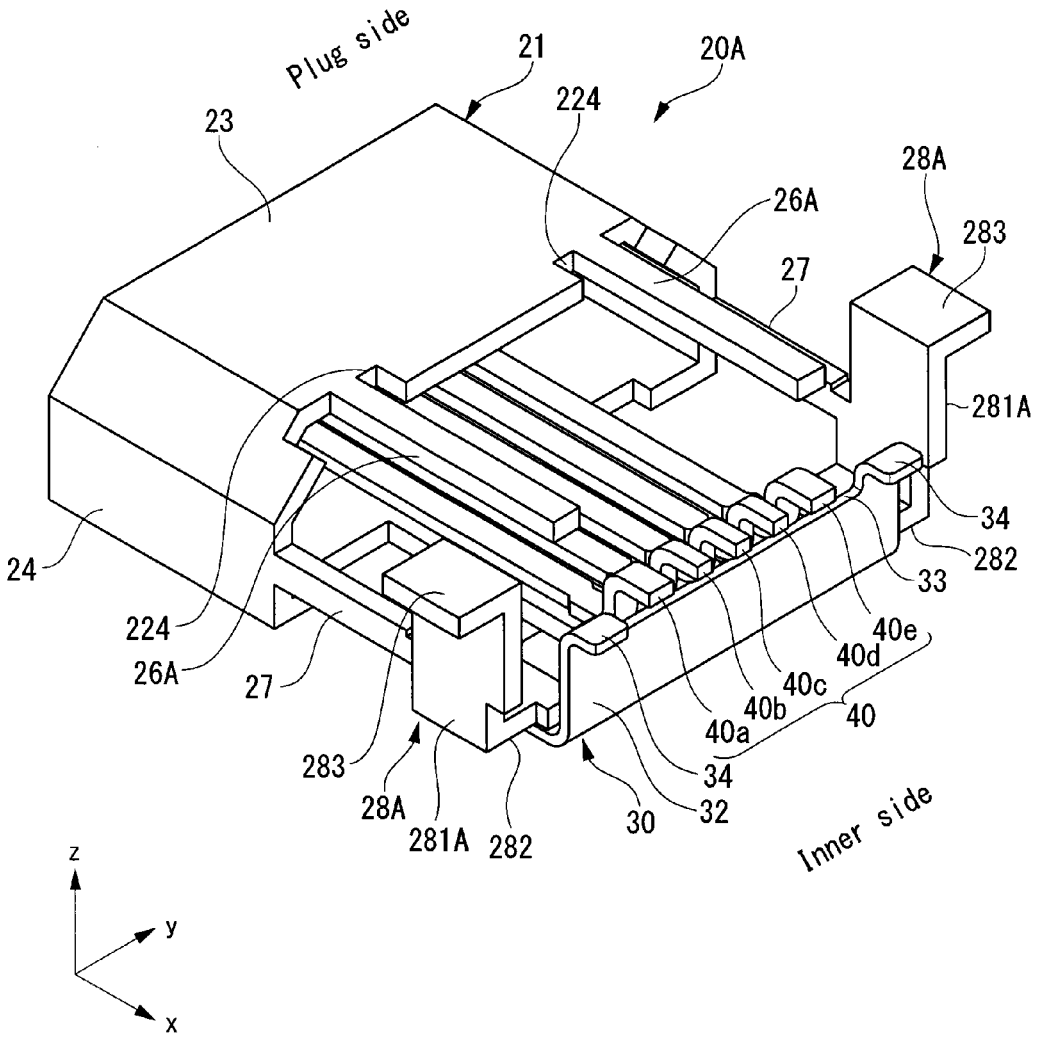
FIG. 8 is a perspective view of a lower surface side of the shell of the connecting device in FIG. 7 according to an exemplary embodiment of the present disclosure.

FIG. 8 is a perspective view of a lower surface side of the shell 20A in FIG. 7 according to an exemplary embodiment of the present disclosure. According to one embodiment of present disclosure, the structure of the shell 20A can be the similar to the shell 20 (in FIG. 4) except for the shape of a comb-tooth. The shell 20A includes a plurality of comb-teeth 26A which protrudes from the lower surface 23 of the shell main body 21 and linearly extends toward the inner side (opposite of the plug insertion side). The plurality of the comb-teeth 26A can contact with the ground part of the printed circuit board 50 (not shown) along the entire length of the plurality of comb-teeth 26A. Thus the contact area of the plurality of the comb-teeth 26A and the printed circuit board 50 increases significantly, and a grounding function is reinforced.

Further, in order to accommodate the plurality of comb-teeth 26A of the shell 20A, the inner side of the housing 10 must be modified. For instance, the height of the inner side of the housing 10A (not shown) is increased compared to the housing 10.

Furthermore, as the height of the inner side of the housing 10A (not shown) increases, the height of a plurality of base portions 281A of a shield member support part 28A is increased as well. Thus the height of the plurality of base portions 281A is larger compared to the height of the plurality of the base portions 281.

Figure 9:
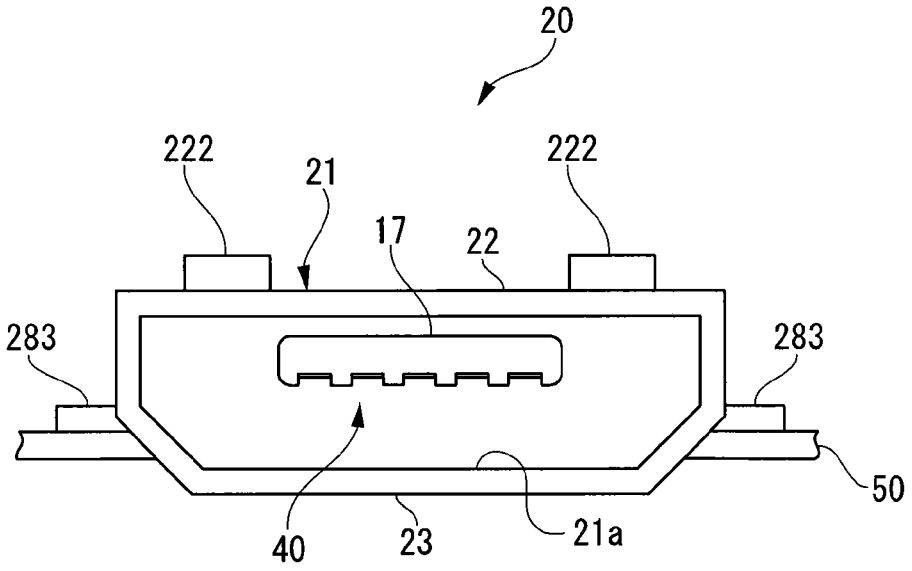
FIG. 9 is the front view of the shell of the connecting device shown in FIG. 1 according to an exemplary embodiment of the present disclosure.

In another embodiment a different shell 20 can be designed for the connecting device 1 in FIG. 1. FIG. 9 is the front view of a normal type shell 20 of the connecting device connected to the printed circuit board 50 according to an exemplary embodiment of the present disclosure.

Figure 10:
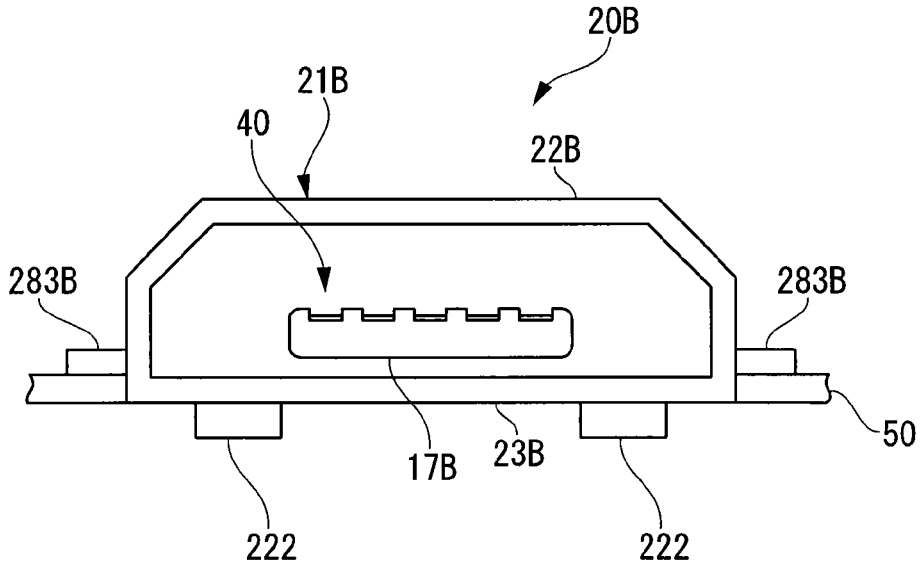
FIG. 10 is the front view of the shell in inverted position according to an exemplary embodiment of the present disclosure.

FIG. 10 is the front view of a shell 20B installed in an inverted position on the printed circuit board 50 according to an exemplary embodiment of the present disclosure. In the reverse type shell 20B, a upper-surface 22B and a lower-surface 23B of a shell main body 21B are upside down compared to the upper surface 22 and the lower surface 23 in a normal type in FIG. 9. In FIG. 10, a support protrusion 17B is also in an inverted position. In an inverted state, grounding portions 283B and 283B of the shell 20B are connected to the ground part of the printed circuit board 50. The position of the support protrusion 17B inside the shell main body 21B closer to the printed circuit board 50 compared to that in FIG. 9. Further, the space between the support protrusion 17B and the upper-surface part 22B is larger compared to that in FIG. 9. The detailed structure of the shell 20B is discussed with reference to FIG. 11.

Figure 11:
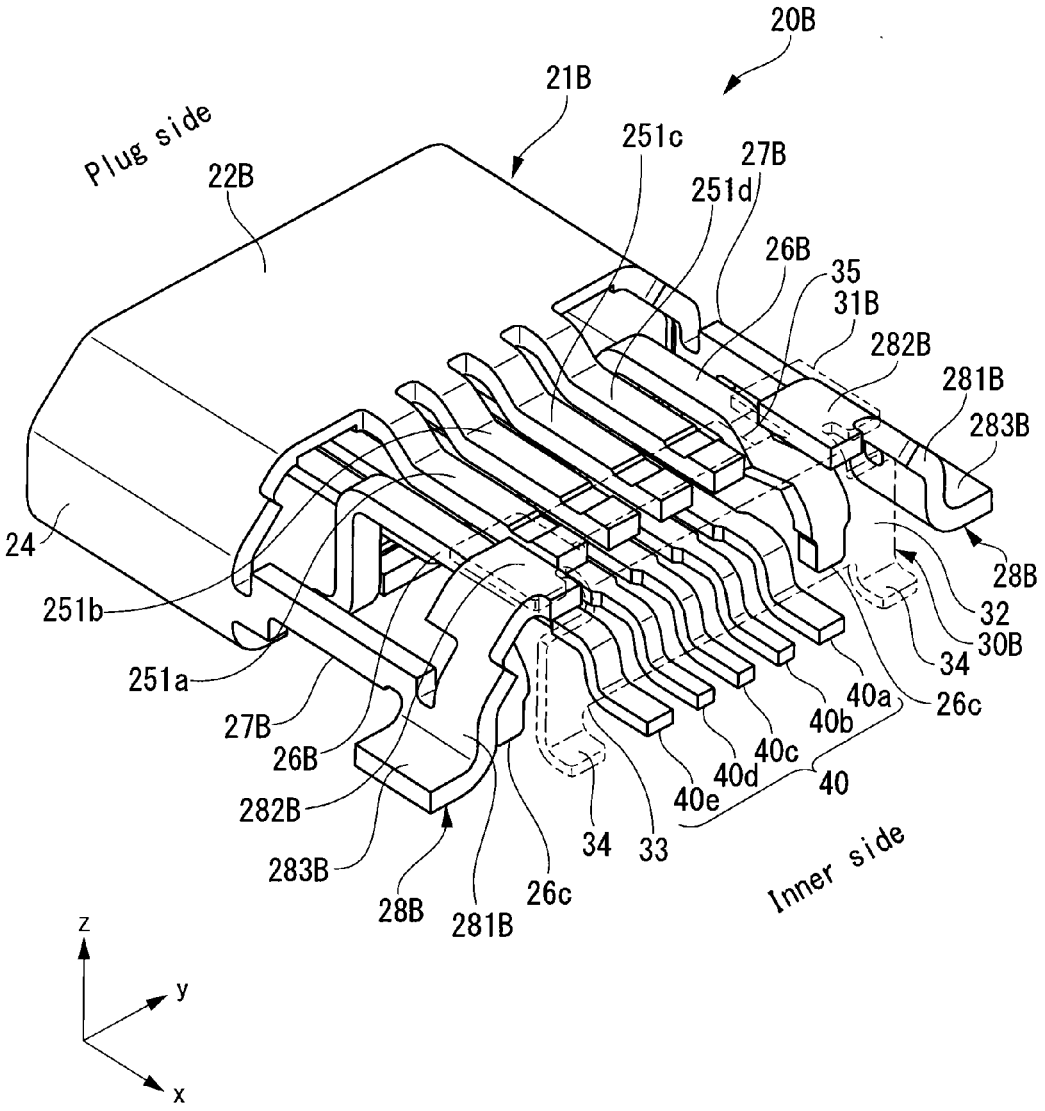
FIG. 11 is the perspective view of the upper surface side of the shell shown in FIG. 10 according to an exemplary embodiment of the present disclosure.

FIG. 11 is the perspective view of the shell 20B when installed in an inverted position as shown in FIG. 10 according to an exemplary embodiment of the present disclosure. According to one embodiment of present disclosure, the structure of the shell 20B can be the similar to the shell 20 (in FIG. 4) except for the shape of a comb-tooth. The shell 20B includes a plurality of comb-teeth 251*a*-251*d* protruding from the edge of the upper-surface part 22B of the shell main body 21B. Additionally, a plurality of comb-teeth 26B protrude from the edge of the lower-surface 23B to the upper surface 22B such that the plurality of comb-teeth 26B and the comb-teeth 251*a*-251*d* are at the same level. The plurality of comb-teeth 26B further extends toward the inner side and remain parallel to the terminals 40*a*-40*e*.

The comb-teeth 251*a*-251*d* extend towards the inner side (in x-direction) from the edge of the upper surface 22B and are slightly bent in a diagonally-downward direction forming a slope part, thus creating a smooth step-like structure. Thus according to one embodiment of present disclosure, the height of comb-teeth 251*a*-251*d* is slightly lower than the height of the upper surface 22B. In another embodiment of the present disclosure, the height of the comb-teeth 25*a*-25*d* was the significantly equal to the height of the upper surface 22.

In order to compensate for the height difference between the comb teeth 251*a*-251*d* and the upper surface 22B, a level difference part 35 is provided on the inner side. The level difference part contacts the first surface 31B of the shield member 30B. Further, a part of the housing 10 (not shown) can be reduced in thickness corresponding to the area where there is a height difference between the comb teeth 251*a*-251*d* and the upper surface 22B Further in another embodiment, when the level difference part 35 is not included, the mounting part 19 (in FIG. 1) of the housing 10 may be of lower height.

FIG. 12 is an arrangement of the terminals of USB Type-C according to an exemplary embodiment of the present disclosure. A USB Type-C is a technical standard in formulation by USB Implementers' Forum. The USB Type-C has a reversible terminal structure which does not distinguish the direction of a connector (plug). As shown in FIG. 12, a female side connector has twelve terminals A1-A12 on the upper side, and has twelve terminals B1-B12 on the lower side. Each of the terminals A1-A12 is point-symmetrical with each of the terminals B1-B12 respectively.

The upper terminals A2, A3, A10, A11 and lower terminals B2, B3, B10, B11 are the terminals for high-speed data transmission.

The upper terminals A6, A7 and lower terminals B6, B7 are the terminals for data communications corresponding to USB2.0.

Figure 13:
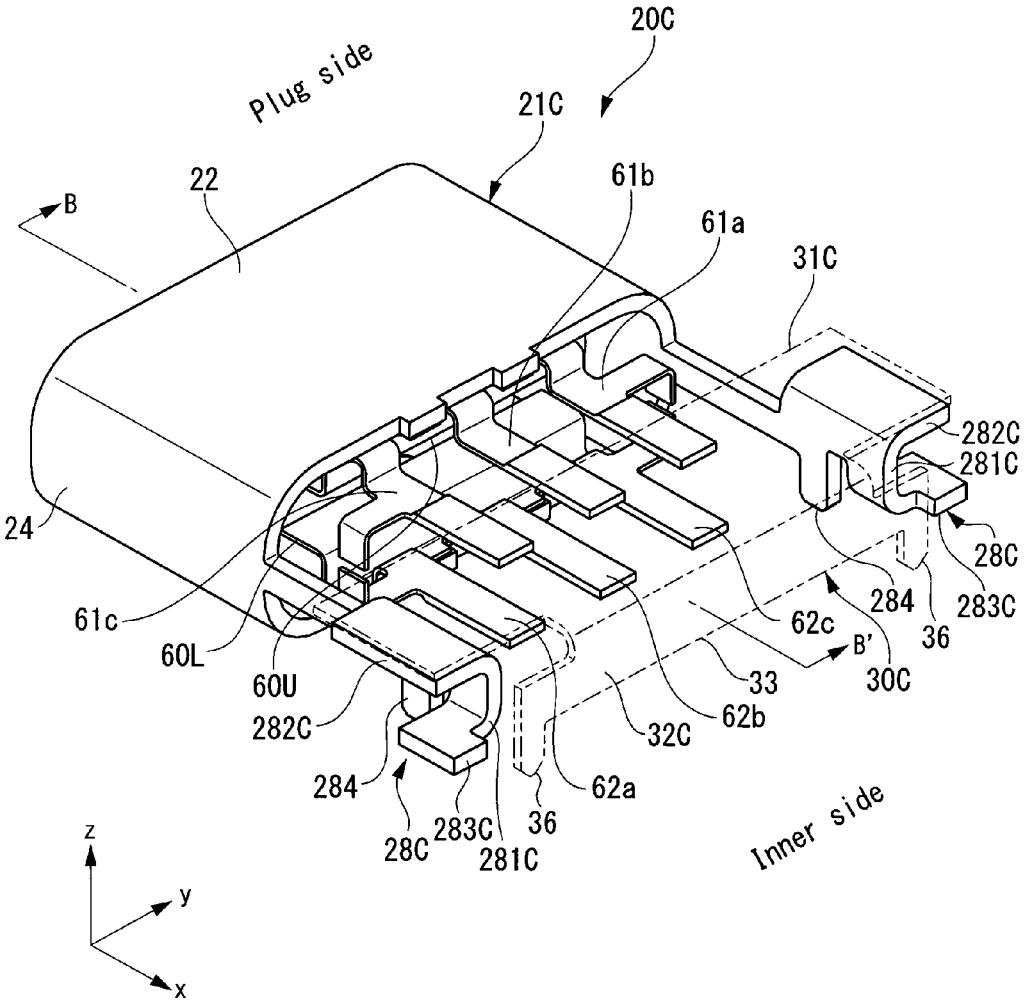
FIG. 13 is the perspective view of the upper surface side of the shell for a connecting device applied to USB Type-C according to an exemplary embodiment of the present disclosure.
Figure 14:
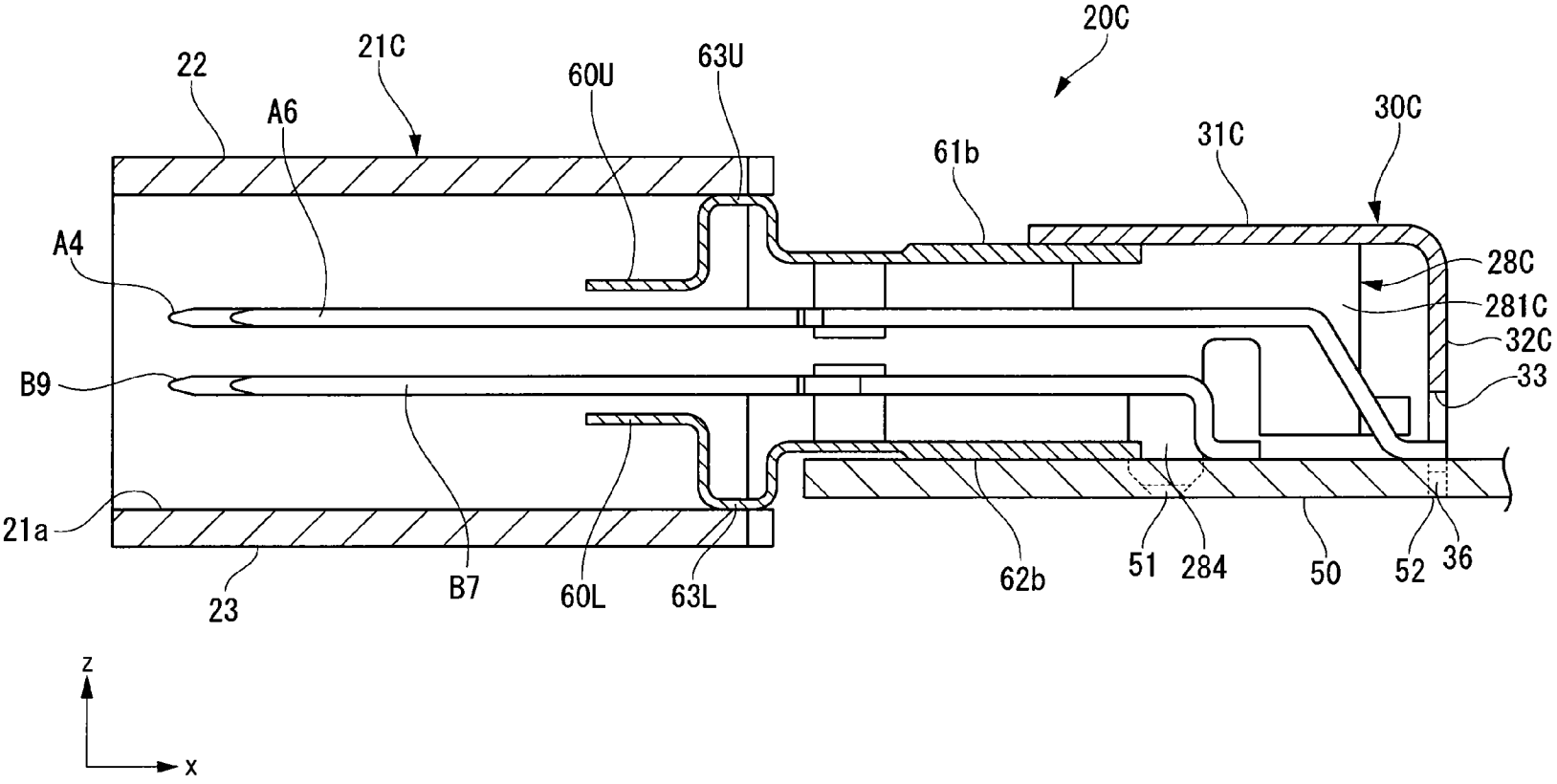
FIG. 14 is the section view of the shell about a section line B-B' shown in FIG. 13 according to an exemplary embodiment of the present disclosure.

In one embodiment, a shell 20C includes terminals corresponding to the terminals of USB Type-C A1-A12, B1-B12. FIG. 13 is the perspective view of the upper surface of the shell 20C for a connecting device which can be connected to a USB Type-C according to an exemplary embodiment of the present disclosure. A shell main body 21C includes a plurality of comb-teeth 61*a*-61*c* and 62*a*-62*c*. The plurality of comb-teeth 61*a*-61*c* protrude from an upper-side sheet metal 60U provided under the upper side 22. While the plurality of comb-teeth 62*a*-62*c* protrude from a lower-side sheet metal 60L provided above the lower side 23 (not marked). The lower-side sheet metal 60L and the upper-side sheet metal 60U are placed inside the shell 20C and do not contact the surface of the shell 20C, as can be seen in FIG. 14. The upper-side sheet metal 60U and the lower-side sheet metal 60L extend in a direction (y direction) perpendicular to a plug insertion direction.

FIG. 14 is the section view of the shell 20D about the BB' axis shown in FIG. 13 according to an exemplary embodiment of the present disclosure. The upper-side sheet metal 60U is equipped with a bending part 63U bent upwards. The bending part 63U contacts with the inner surface of upper-surface part 22 of shell main body 21C. Each of the plurality of comb-teeth 61*a*-61*c* protrudes from the edge of the bending part 63U. Further, the comb-teeth 61*a*-61*c* are bent in a downward direction (z direction) from the edge of the bending part 63U, and are bent again parallel to plug insertion direction (x direction). Further, the comb-teeth 61*a*-61*c* may have an increased thickness compared to the thickness of 63U to attached, for instance by soldering, to the upper surface 31C of the with shield member 30C.

The lower-side sheet metal 60L is equipped with a bending part 63L bent downwards. The bending part 63L contacts with the inner surface of the lower-surface 23 of shell main body 21C. Each of the plurality of comb-teeth 62*a*-62*c* protrudes from the edge of the bending part 63L. Further, the comb-teeth 62*a*-62*c* are bent in a upward direction (z direction) from the edge of the bending part 63L, and are bent again parallel to plug insertion direction (x direction). Further, the comb-teeth 62*a*-62*c* may have an increased thickness compared to the thickness of 63L to attached, for instance by soldering, to the printed circuit board 50.

In another embodiment the upper-side bending part 63U and lower-side bending part 63L structure may not be included if enough structure is provided for the comb teeth 61*a*-61*c* and 62*a*-62*c* protrude directly from the edge of shell main body 21C.

A pair of shield member support parts 28C of the shell 20C is similar to the shield member support parts 28 according to one embodiment of the present disclosure. Further, a base portion 281C of the support part 28C, a upper-surface 282C, and a grounding portion 283C of the shield member support parts 28C have a similar structure and function as the base portion 281 of the support part 28, the upper-surface 282, and the grounding portion 283 of the shield member support parts 28. The base part portion 281C of the support part 28C has a protrusion 284 inserted in a pair of holes 51 of the printed circuit board 50. The shell 20C stays grounded and fixed, for instance by soldering, to the ground part of the printed circuit board 50 via the protrusions 284 inserted in a pair of holes 51.

Furthermore, the pair of the support parts 28 supports the shield member 30C. The shield member 30C has a first surface 31C, a second surface 32C, a cutout 33 and protrusions 36 (also refer to FIG. 13) on either side of the cutout 33. The protrusions 36 are inserted in a pair of holes 52 of the printed circuit board 50. The shield member 30C stays grounded and fixed, for instance by soldering, to the ground part of the printed circuit board 50 via the protrusions 36 inserted in a pair of holes 52.

The plurality of the comb-teeth 61*a*-61*c* and 62*a*-62*c* are positioned from the upper-surface part 22 and the lower-surface part 23 of shell main body 21C such that they may correspond to some terminal of A1-A12 and B1-B12 thorough which a data transmission occurs. The noise generated from a terminal or external sources can be efficiently reduced by limiting comb-teeth arrangement only to the terminal through which a data transmission occurs. Thus, the distance of the upper comb-teeth 61*a*-61*c* and the lower comb-teeth 62*a*-62*c* may be shorter; eventually reducing the housing (not shown) thickness.

The present exemplary embodiment is not limited to the structure of the connecting device for the USB type C female side connector. The connecting device may also be applicable with respect to a different female side connector in which another male side connector (plug) may be inserted.

According to the present disclosure, the connecting device and electronic device structure is discussed, where a part of shell main body on the inner side (opposite side of the plug insertion) includes a plurality of terminals insert-molded along with the housing is enclosed by a metallic part and the metallic part is grounded via the ground of a printed circuit board. Specifically, a shield member is provided to cover the edge part of a plurality of comb-teeth, which project from a shell main body. Further, the plurality of comb-teeth is grounded directly via the shield member.

The connecting device according to the present disclosure reduces the noise generated from the plurality of the terminal and external sources, and improves the electrical property of the connecting device. Moreover, projecting the plurality of the comb teeth from a shell main body the contact area of the shell and the housing is reduced resulting in noise reducing and a waterproof structure.

The connecting device of the present disclosure has several applications. For instance, it can be applied to an electronic device having a connection device (a female side connector) into which a plug (a male side connector) of a USB connector, for example, is to be inserted. Examples of the electronic device include but not limited to a mobile terminal device, a smartphone, a tablet, an e-book reader, a game terminal, a wearable terminal, a camera-equipped smartphone and the like.

Also, it should be understood that this technology when embodied is not limited to the above-described embodiments and that various modifications, variations and alternatives may be made of this technology so far as they are within the spirit and scope thereof.

What is claimed is:

1. A connection device comprising:

a housing having tubular rectangle shape and a support portion integrally formed with the housing;

a shell having a body portion with tubular rectangle shape, wherein the shell is supported by the support portion of the housing, the body portion of the shell is provided with a first plurality of comb-teeth which project from an end side of an upper face of the body portion;

a shield member configured to surround an end portion of the first plurality of comb-teeth of the body portion of the shell, and wherein the shield member is connected with the end portion of the first plurality of comb-teeth and the ground of a printed-circuit board; and a plurality of terminals arranged within the shell and supported by the support portion of the housing.

2. The connection device according to claim 1, wherein the housing further comprises a sealing member arranged around the housing, wherein the sealing member is brought into pressure contact with a face of a casing of an electronic device.

3. The connection device according to claim 2, wherein the housing is configured to attach the sealing member in a position deeper than the body portion of the shell of the housing.

4. The connection device according to claim 1, wherein the body portion of the shell is configured to hold a plug.

5. The connection device according to claim 1, wherein the first plurality of comb-teeth are arranged at positions corresponding to respective terminals for transmitting data, among the plurality of terminals.

6. The connection device according to claim 1, wherein the first plurality of comb-teeth are formed in the body portion of the shell in a plug insertion direction at positions corresponding to the plurality of terminals respectively.

7. The connection device according to claim 6, wherein each of the first plurality of comb-teeth has a portion parallel to the direction in which the plurality of terminals extend.

8. The connection device according to claim 6, wherein a connecting portion extending in the plug insertion direction is provided on an end of a side face of the body portion of the shell, wherein the connecting portion connects the side face of the body portion of the shell and the shield member.

9. The connection device according to claim 8, wherein a second plurality of comb-teeth projecting from an end side of a lower face of the body portion of the shell.

10. The connection device according to claim 9, wherein the second plurality of comb-teeth projecting from the lower face of the body portion has a portion with the significantly similar height as that of the first plurality of the comb-teeth projecting from the upper face.

11. The connection device according to claim 9, wherein the second plurality of comb-teeth projecting from the lower face of the body portion of the shell extends straight in the plug insertion direction from the connecting portion thereof connecting with the body portion.

12. The connection device according to claim 9, wherein a third plurality of comb-teeth projecting from the upper face and the lower face of the body portion of the shell, wherein the third plurality of comb-teeth correspond to the positions of the terminals, among the plurality of terminals, for transmitting data in a universal serial bus connector of type-C.

13. The connection device according to claim 1, wherein the shield member has a first surface and a second surface, wherein the first surface is parallel to the first plurality of comb-teeth, and the second surface is perpendicular to the first surface.

14. The connection device according to claim 13, wherein a cutout is formed in the second surface of the shield member, at a position corresponding to the end portion of the first plurality of comb-teeth.

15. The connection device according to claim 1, wherein the shell is made of a metal.

16. The connection device according to claim 1, wherein the shield member is made of a metal.

17. A electronic device apparatus comprising:

a connection device that includes a housing having tubular rectangle shape and a support portion integrally formed with the housing, a shell having a body portion with tubular rectangle shape, wherein the shell is supported by the support portion of the housing, and the body portion of the shell is provided with a first plurality of comb-teeth which project from an end side of an upper face of the body portion, a shield member configured to surround an end portion of the first plurality of comb-teeth of the body portion of the shell, wherein the shield member is connected with the end portion of the first plurality of comb-teeth and the ground of a printed-circuit board, and a plurality of terminals arranged within the shell and supported by the support portion of the housing; and a casing for housing the printed-circuit board connected to the plurality of terminals and the shield member of the connection device.

* * * * *